US005924943A

United States Patent [19]

Sklar

[11] Patent Number: 5,924,943

[45] Date of Patent: Jul. 20, 1999

[54] ADJUSTABLY WEIGHTED SHUTTLECOCK

[76] Inventor: Allan Sklar, 10399 Belmont, Pierrefonds, Quebec, Canada, H8Y 2J1

[21] Appl. No.: 09/012,351

[22] Filed: Jan. 23, 1998

[51] Int. Cl.[6] ..... A63B 67/18

[52] U.S. Cl. ..... 473/579

[58] Field of Search ..... 473/579, 580, 473/FOR 217

[56] References Cited

U.S. PATENT DOCUMENTS

| | | | |
|---|---|---|---|
| 1,620,922 | 3/1927 | Saunders | 473/579 |
| 2,359,726 | 10/1944 | Booty | 473/580 |
| 2,853,302 | 9/1958 | Wolf | 473/579 |
| 3,749,402 | 7/1973 | Adickes et al. | 473/579 |
| 4,657,262 | 4/1987 | Buckland | 473/580 |

FOREIGN PATENT DOCUMENTS

| | | | |
|---|---|---|---|
| 889867 | 1/1944 | France | 473/FOR 217 |
| 1704 | of 1894 | United Kingdom | 473/FOR 217 |

*Primary Examiner*—John A. Ricci
*Attorney, Agent, or Firm*—Eric Fincham

[57] ABSTRACT

A shuttlecock having a base and a flight portion, the base having a semi-spherical bottom and an upwardly extending side wall, with at least one length of tape having lengths substantially equal to a multiple of the circumference of the upwardly extending wall extending thereabout, the length of tape having a first side coated with a releasable pressure sensitive adhesive material and an opposite side forming a release surface for the releasable pressure sensitive adhesive material. The lengths of tape can be added to or removed from the shuttlecock to change the weight and thereby change the flight characteristics of the shuttlecock.

7 Claims, 1 Drawing Sheet

ADJUSTABLY WEIGHTED SHUTTLECOCK

BACKGROUND OF THE INVENTION

The present invention relates to shuttlecocks and more particularly, relates to shuttlecocks having adjustable weighting.

In the game of badminton, a well known problem with the shuttlecocks or "birds" is the variation in the flight speed of the shuttlecock. This variation is the result of many factors including the inherent characteristics of the bird, the temperature at the court, the humidity level, altitude, and the amount of time the bird has been in use. Particularly among the more skilled players, after a bird has been used for between 15–30 minutes, the "speed" of the bird increases beyond a level considered desirable.

In order to compensate for the above, it is common practice to attempt to alter the upper flight or flights of the bird to slow the speed of the bird. Understandably, this is a rather imprecise manner of adjusting the speed.

This problem has been known for a long time and for many years various proposals to provide for adjustable birds have been made. Thus, in U.S. Pat. No. 2,116,304 to Crespin, a ring member is moved upwardly or downwardly to increase the diameter of the flights to thus change the characteristics thereof. A similar solution has been proposed in U.S. Pat. No. 4,657,262 to Buckland.

It is also known that adjusting the weight of the shuttlecock will affect the speed of the bird. Various means for adjusting the weight are shown in U.S. Pat. Nos. 2,059,930 to Booth; 2,093,301 to Bauer; and 2,192,180 to Collier.

While such proposals have been advanced in the art, none have received any great degree of commercial acceptance.

SUMMARY OF THE INVENTION

It is therefore an object of the present invention to provide a shuttlecock wherein the weight of the shuttlecock may be easily modified.

It is a further object of the present invention to provide for a shuttlecock wherein the speed of the shuttlecock may be varied by the addition/removal of circumferentially extending releasable tape elements.

According to one aspect of the present invention, there is provided in a shuttlecock having a base and a flight portion, the base having a semi-spherical bottom and an upwardly extending side wall, the improvement comprising at least one length of tape extending circumferentially around the upwardly extending side wall, the at least one length of tape having a weight of between 0.01 and 0.5 grams, the length of tape having a first side thereof coated with a releasable pressure sensitive adhesive material, an opposite side thereof forming a release surface.

According to a further aspect of the present invention, there is provided a shuttlecock kit comprising a shuttlecock and a plurality of lengths of tape, the shuttlecock comprising a base and a flight portion, the base having a semi-spherical bottom and an upwardly extending side wall, each of the tapes having a weight of between 0.01 and 0.5 grams, each of the lengths of tape having a first side thereof having a releasable pressure sensitive adhesive material applied thereto, an opposite side forming a release surface.

According to a still further aspect of the present invention, there is provided in a shuttlecock having a base and a flight portion, the base having a semi-spherical bottom and an upwardly extending side wall, the improvement comprising a plurality of lengths of tape, each of the lengths of tape having a length substantially equal to a multiple of the circumference of the upwardly extending side wall, each of the lengths of tape having a different weight, each of the lengths of tape having a first side thereof coated with a releasable pressure sensitive adhesive material, an opposite side thereof forming a release surface for the releasable pressure sensitive adhesive material.

The invention will be described with respect to a shuttlecock having a base portion formed of a cork material with a cover thereabout and having a flight portion of a one-piece plastic structure. Such shuttlecocks are very common in the sport. However, it will be understood that the improvements of the present invention may equally well be applied to other shuttlecock constructions including ones wherein the flight portion is made of feathers or other members and wherein the base is formed of other materials such as rubber or plastic materials.

As aforementioned, the base of the shuttlecock is normally formed of a cork material with the bottom being of a generally spherical configuration and having an upwardly extending side wall from the spherical portion. In order to provide protection to the cork, it is conventionally provided with a cover of a fabric material, plastic or leather type material. This cover is normally adhesively secured to the cork base or head.

The upper flight portion is normally embedded in the cork base and adhesively secured thereto. As aforementioned, other structures are known wherein the flight portion comprises feathers or feather like members which are also inserted into the base.

According to the present invention, there is provided one or more lengths of tape which extend circumferentially around the upwardly extending side wall. The number of layers of tape may naturally be any suitable with there being preferably between one–four layers of tape.

Each tape length preferably has a length substantially equal to the circumference of the upwardly extending side wall so as to provide uniform flight characteristics although other lengths may be used.

The tape may be of any suitable material such as a plastic with one side thereof having a pressure sensitive releasable adhesive material thereon. Such materials are well known in the art. As such, each tape length may be easily removed and/or re-applied a number of times. The opposite side forms a release layer.

Preferably, each tape length has a weight of between 0.01 and 0.5 grams and even more preferably between 0.05 and 0.2 grams. As an alternative, one could have different types of tape each having different weights. In such an embodiment, means for differentiating between the tape weights could be employed, such means including color coded means.

As a further alternative, the shuttlecock could, at the time of manufacture, have a plurality of tape lengths extending circumferentially around the upwardly extending side wall and as the speed of the bird increases during use, one or more tapes could be removed with the tapes being color coded to indicate bird weight.

In practice, the use of the removable tape lengths extending circumferentially about the upwardly extending side wall would allow for ease of manufacture of the shuttlecocks for many different end users. Thus, a predetermined number of tape lengths could initially be applied to the shuttlecock depending upon the final destination. In other words, a different number of layers could be applied depending whether the shuttlecock was to be used in a high altitude location and/or if different speeds of the shuttlecock were desired.

As aforementioned, one side of the tape has a pressure sensitive releasable adhesive applied thereto with the other side of the tape forming a release surface therefor. Such tapes are well known in the art.

In a preferred embodiment, the ends of the various tape lengths would not coincide with each other to thereby prevent the accidental removal of more than one layer of tape at a time.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
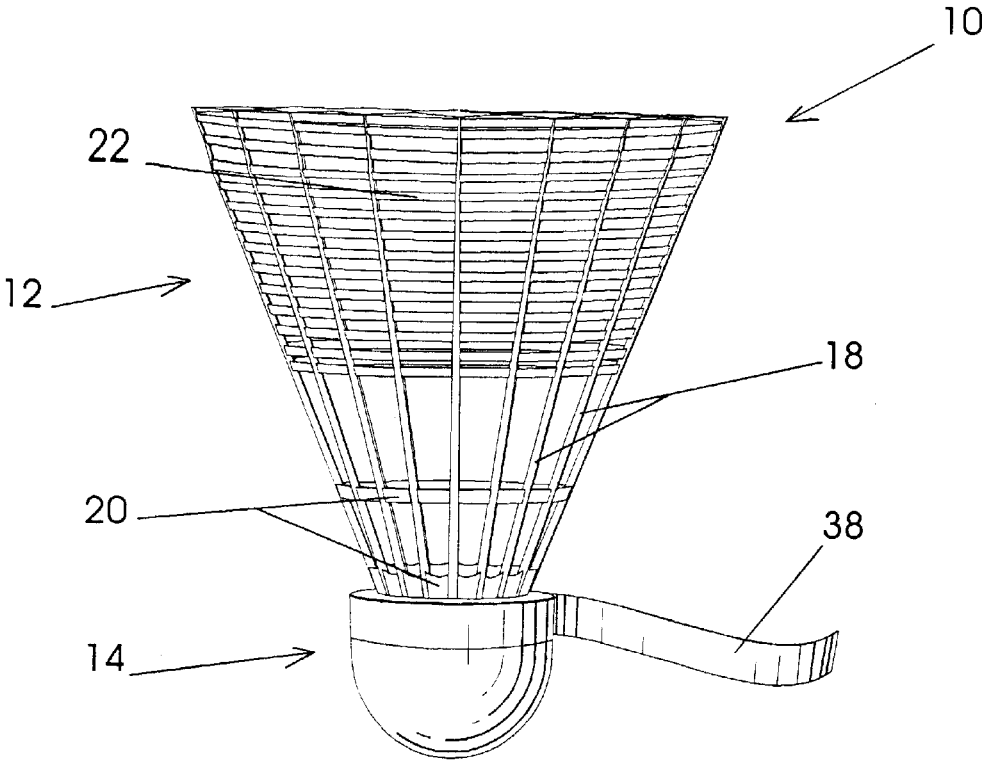
FIG. 1 is a side elevational view of a shuttlecock incorporating the improvement of the present invention.
Figure 2:
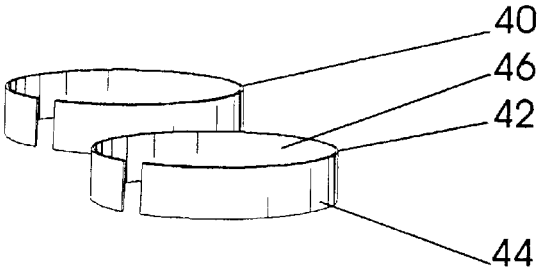
FIG. 2 is a perspective view illustrating the removable lengths of tape.

Referring to the drawings in greater detail and by reference characters thereto, there is illustrated in FIG. 1 a shuttlecock generally designated by reference numeral 10, and which shuttlecock 10 is comprised of an upper flight portion 12 and a lower base portion 14.

Upper flight portion 12 is formed in a substantially conventional manner of a plastics material and has a plurality of upwardly and outwardly extending vanes 18. In the lower portion of flight 12 there are provided circular ribs 20 interconnecting vanes 18 while in the upper portion of flight 12 there is provided a type of netting 22 extending between vanes 18. This structure is one of the ones widely used in the sport of badminton.

Base 14 has a cork body 24 which has a configuration incorporating a lower hemispherical portion generally designated by reference numeral 26 and an upper cylindrical portion generally designated by reference numeral 28. Cylindrical portion 28 has a side wall 30 which extends upwardly from spherical portion 26.

Extending about the cork body 24 including lower hemispherical portion 26 and upper cylindrical portion 28 is a cover 30. Cover 30 is adhesively secured to cork body 24.

In the upper portion of cork body 24 there are provided recesses 34 to receive vanes 18 of flight 12. The vanes 18 are preferably adhesively secured to cork body 24.

Figure 3:
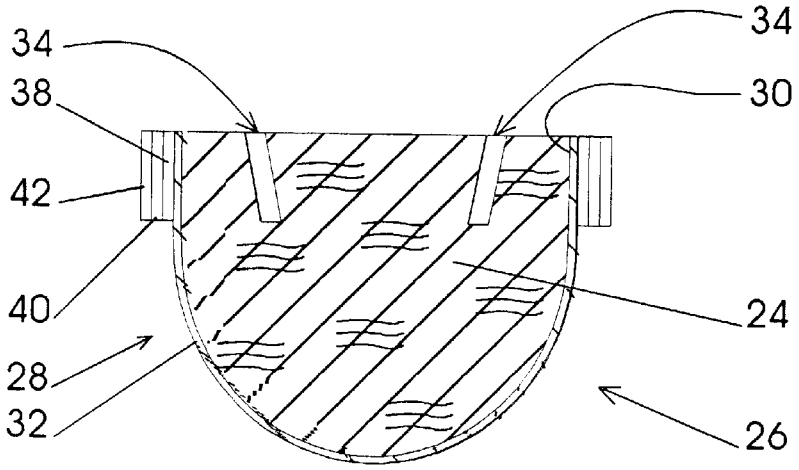
FIG. 3 is a sectional view through the base of the shuttlecock.

As shown in FIG. 3, there are provided three lengths of tape 38, 40 and 42. As shown with respect to length of tape 42, there is provided an outer surface 44 and an inner surface 46. Inner surface 46 is coated with a pressure sensitive releasable adhesive while outer surface 44 forms a release surface for the pressure sensitive releasable adhesive.

Lengths of tape 38, 40 and 42 are designed to be secured about cylindrical wall portion 30 as shown in FIG. 3. As the need to change the flight characteristics of the shuttlecock 10 become necessary, initially tape 42 can be removed. As further play requires, tapes 40 and 38 can also be removed if required, As previously mentioned, in an alternative embodiment, tapes 38, 40 and 42 may be of different weights and thus one length of tape could be replaced with another.

It will be understood that the above described embodiment is for purposes of illustration only and that changes and modifications may be made thereto without departing from the spirit and scope of the invention.

I claim:

1. In a shuttlecock having a base and a flight portion, said base having a semi-spherical bottom and an upwardly extending side wall, the improvement comprising at least one length of tape extending circumferentially around said upwardly extending side wall, said at least one length of tape having a weight of between 0.01 and 0.5 grams, said length of tape having a first side thereof coated with a releasable pressure sensitive adhesive material, an opposite side thereof forming a release surface.

2. The improvement of claim 1 wherein there are provided between one and four of said lengths of tape, each one of said lengths of tape having a length substantially equal to the circumference of said upwardly extending side wall.

3. The improvement of claim 2 wherein each one of said lengths of tape has a different color.

4. The improvement of claim 3 wherein each one of said lengths of tape has a different weight, each of said colors indicating the weight of the length of tape.

5. The improvement of claim 1 wherein said shuttlecock has a flight portion which is of a one-piece structure of a plastic material.

6. A shuttlecock kit comprising a shuttlecock and a plurality of lengths of tape, said shuttlecock comprising a base and a flight portion, said base having a semi-spherical bottom and an upwardly extending side wall, said lengths of tape each having a tape length substantially equal to a multiple of the circumference of said upwardly extending side wall, each of said tapes having a weight of between 0.01 and 0.5 grams, each of said lengths of tape having a first side thereof having a releasable pressure sensitive adhesive material applied thereto, an opposite side forming a release surface.

7. In a shuttlecock having a base and a flight portion, said base having a semi-spherical bottom and an upwardly extending side wall, the improvement comprising a plurality of lengths of tape extending about said upwardly extending side wall, each of said lengths of tape having a weight of between 0.01 and 0.5 grams, each of said lengths of tape having a first side thereof coated with a releasable pressure sensitive adhesive material, an opposite side thereof forming a release surface for said releasable pressure sensitive adhesive material.

* * * * *